United States Patent [19]

Curzio

[11] 4,271,570

[45] Jun. 9, 1981

[54] GRAPHITE FIBER ALIGNMENT PROCESS AND APPARATUS

[75] Inventor: Frederick H. Curzio, Garden Grove, Calif.

[73] Assignee: Textile Products, Inc., Anaheim, Calif.

[21] Appl. No.: 933,658

[22] Filed: Aug. 14, 1978

[51] Int. Cl.[2] ..... B65H 54/20

[52] U.S. Cl. ..... 28/290; 28/166; 28/222; 28/180; 242/18 D; 242/35.5 R; 242/54 R; 139/420 R

[58] Field of Search ..... 28/222, 166, 180; 242/290, 18 D, 37 R, 35.5 R, 1, 54 R, 36

[56] References Cited

U.S. PATENT DOCUMENTS

| | | | |
|---|---|---|---|
| 1,711,279 | 4/1929 | Meyer-Gaus | 242/36 |
| 1,948,646 | 2/1934 | Bruenn | 28/180 |
| 3,178,123 | 4/1965 | Buddecke | 242/54 R |
| 3,327,502 | 6/1967 | Willer | 28/166 |
| 3,412,848 | 11/1968 | Ryckebosch | 242/1 |
| 3,802,636 | 4/1974 | Ogawa | 242/35.5 R |
| 3,836,086 | 9/1974 | Kodama | 242/35.5 R |

*Primary Examiner*—Henry Jaudon
*Attorney, Agent, or Firm*—Willie Krawitz

[57] ABSTRACT

Misaligned strands in a graphite fiber on tape are aligned and wound up on reels with a minimum of degradation by the steps of: separating the individual strands, diverging the strands, aligning the strands and winding the individual strands onto separate take-up reels in one continuous operation.

Graphite fabric woven from the strands exhibit little or no degradation and have a uniform density and excellent physical properties. The alignment apparatus is inexpensive, simple to operate and occupies a relatively small space.

10 Claims, 7 Drawing Figures

GRAPHITE FIBER ALIGNMENT PROCESS AND APPARATUS

BACKGROUND OF THE INVENTION

This invention relates to a new and improved process and apparatus for aligning graphite strands from fibers and to a fully woven graphite fabric which may be produced therefrom.

In the graphitizing of fiber, it is desireable to have high furnace throughput rates to lower production costs. For this purpose, original fibers such as cellulosics, polymer types, etc., are introduced into the graphitizing furnace in narrow, compact strips, and are graphitized in this form. Subsequently, these strips are placed on a paper backing as a tape. However, during the graphitizing process, the fibers tend to become crossed, fused together, etc.; heretofore, no practical way has been found to either align the fibers or the individual strands therein from the tape.

It has been considered that converting a woven or non-woven tape of graphitized fiber into aligned strands would significantly degrade physical properties of the fiber if it could be converted at all.

Graphitized cloth can be produced by passing a pre-woven cloth through a graphitizing furnace, but the fabric strength loses uniformity because the physical properties in the warp direction and filling direction are different due to tension differences imparted by the rollers which forward the fabric through the furnace.

Certain types of graphite utilization, other than weaving, usefully employ single end strands of graphite which are conveniently wound on a spool. This permits ease of storage and shipment and also enables individual strands to be utilized readily, such as in a winding process applied to nose cones, and other graphite filament reinforced articles, etc.

THE INVENTION

According to the invention, a process is provided for converting graphitized fiber in tape form, into individual strands on a reel; the strands may be utilized for weaving into graphite fabric without significant deterioration in physical properties. As illustrated in the SEM micrographs, herein, a bundle of fibers comprise a strand.

The process and apparatus therefor comprises the steps of:

i. initially separating the individual graphite strands from the strip or support tape;
ii. diverging the strands while unwinding from the strip or tape under tension;
iii. feeding each strand through a separate alignment tube; and,
iv. winding up each strand on a separate reel under uniform tension.

The reels of graphitized strands may be used to produce graphite fabric on conventional equipment, or the wind up step (iv) can be by-passed and the individual strands can be fed directly to the graphite weaving process. The graphite strands on the reels may also be used for application, say by winding, onto a substrate to produce a graphite reinforced or coated structure. The graphite strands also may be interwoven with strands from other processes.

The novel apparatus for carrying out the process of this invention is comparatively small, about 5'×5'×12', light and inexpensive, and this size will accommodate a tape of graphitized strands having about 300 ends; larger or smaller size machines can process varying numbered ends.

Strands produced from the tape have a uniform density and are thermally stable even near absolute zero. Typical strands vary in size from about 4–30 mils, and higher; the strands have a wide variety of modulus of elasticity values and represent very little, if any, reduction from the tensile values of the strands on the tape prior to separation and reel wind up. Graphite fabric woven from the separated strands may be employed, among other things, as a support for fragile mirrors; for this purpose, the fabric has isotropic properties and is very convenient to use since it can easily follow the mirror contour. The small strand bundle size makes possible prepegs with a 2–3 mil thickness; also, fabrics 3–5 mils thick may be produced.

DESCRIPTION OF THE PREFERRED EMBODIMENT

Figure 1:
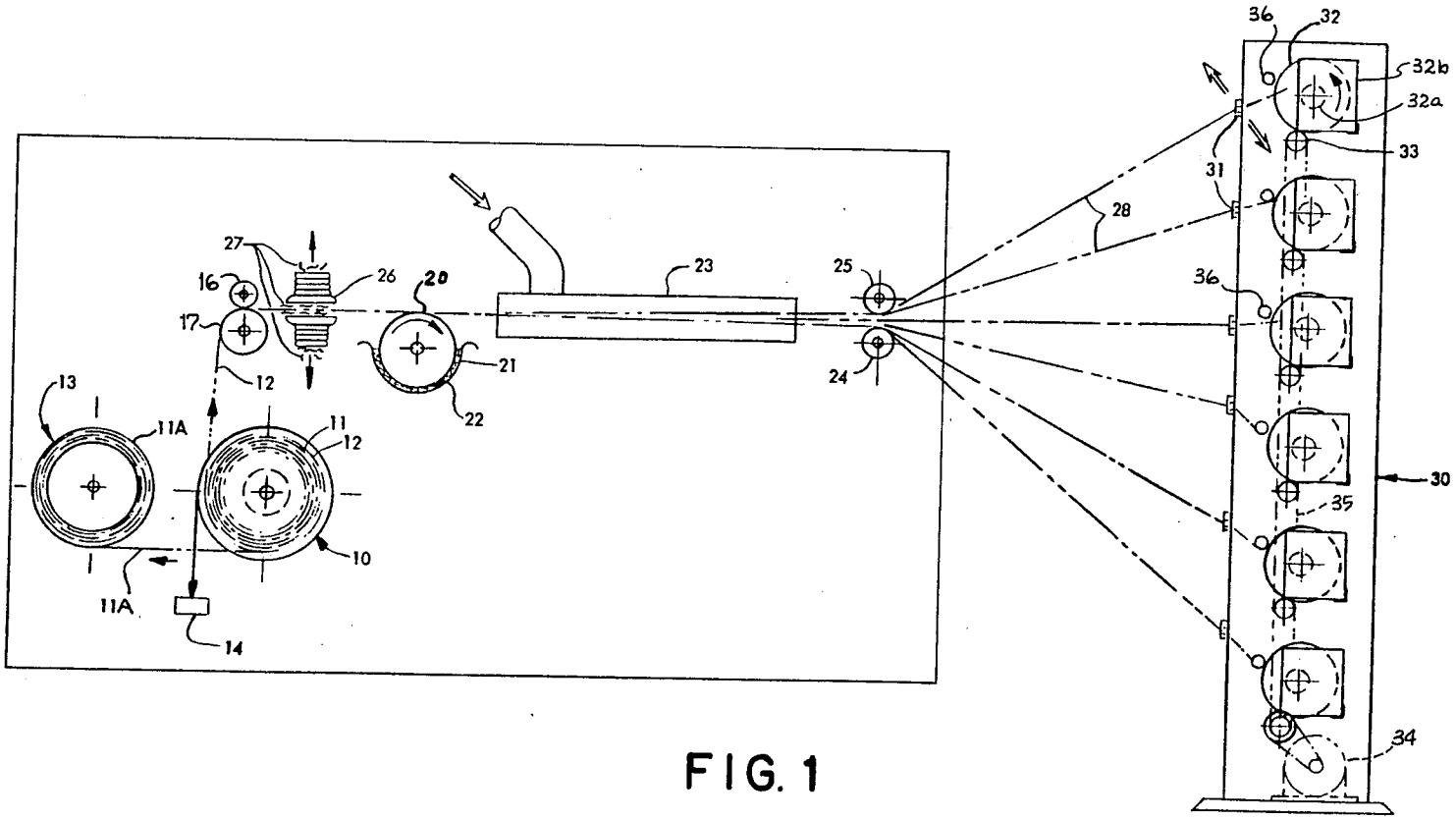
FIG. 1 is a schematic representation of the apparatus of this invention employed to produce aligned strands of graphite; and, FIGS. 2–5 are SEM micrographs at low magnification of graphite fabric woven from the aligned strands according to the apparatus and process of FIG. 1.
Figure 2:
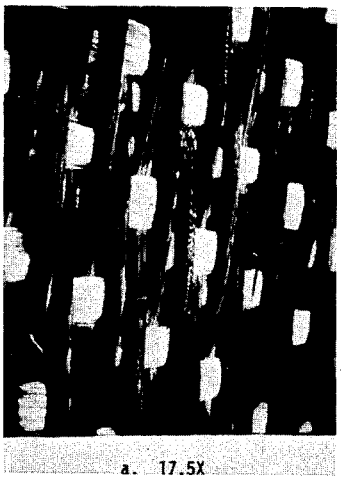
Figure 3:
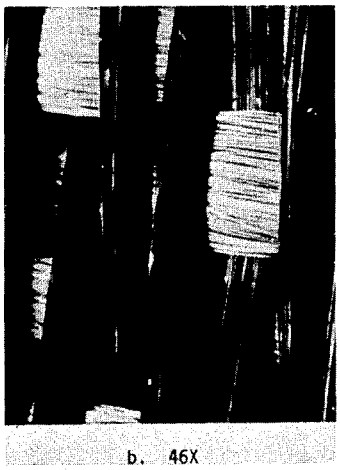
Figure 4:
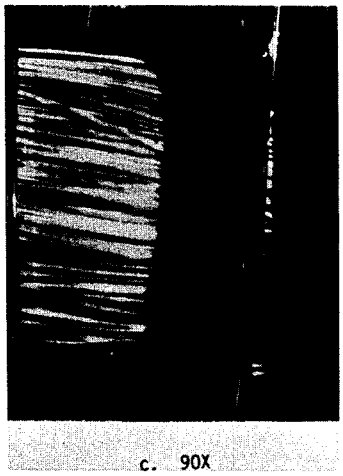
Figure 5:
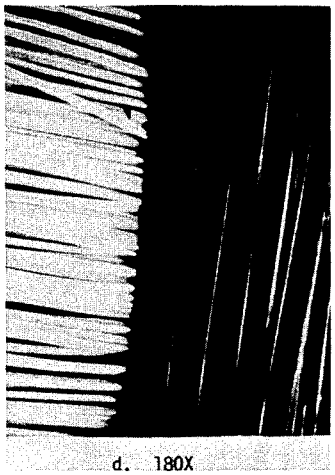
Figure 6:
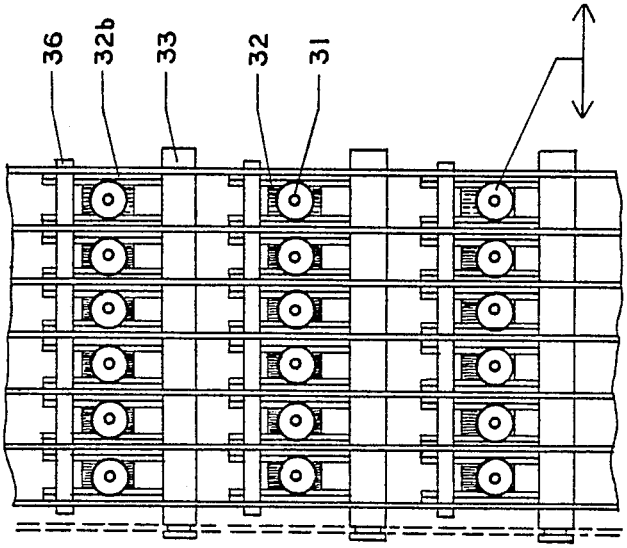
FIG. 6 shows a portion of the array of take up reels for winding individual strands; and, FIGS. 7 (*a–c*) show enlarged views of alignment tubes or guide eyes for directing individual strands to a take up reel.

The apparatus for producing aligned strands according to the invention is shown in FIGS. 1 and 6 and comprises a supply reel 10 bearing a graphite tape supply roll 11 having a flat band of graphite fibers 12. The graphite tape employed is sold by the Celanese Corporation Advanced Engineering Composites, under the registered trademark of "Celion GY-70" and containing a light, carbonized filling yarn to maintain collimation; the "Celion GY-70" will be more fully described, infra. A take up reel 13 is employed to wind up an exhausted roll 11*a* under tension as it separates from the band of graphite fibers 12. The reel 10 is provided with a suspended weight 14 that produces a suitable strand tension in the direction shown by the arrow during wind-up; obviously, tension producing control devices other than weights may be employed to control strand tension. Also, additional tension is supplied since the entire roll surface is firmly secured within the feed supply reel 10. As the fiber band is passed between nip rolls 16, 17 the carbonized filling yarn of the "Celion GY-70" is destroyed and enables the strands to be separated. The fibers may then be sized by passing over a roller 20 in a tank 21 containing sizing solution 22 which coats the fibers, however, the sizing step may be omitted depending on end use requirements. The strands are then passed through a drying zone 23 where they are diverged, and then passed through spaced (about ½") rollers 24, 25, the strands being diverged further both in the vertical and horizontal direction. Vacuum elements 26 are positioned adjacent rollers 16, 17 to remove graphite particles 27 from the destroyed filling yarn which may be formed during the process.

Figures 7A, 7B, 7C:
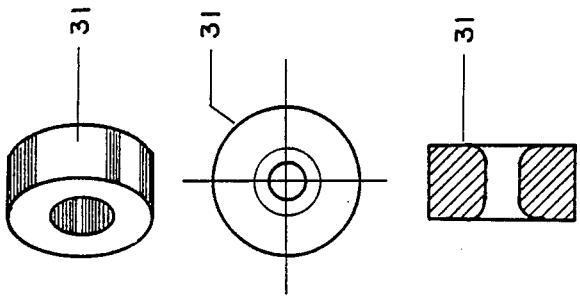

When a new tape supply roll 11 is started up, the individual strands are separated from the tape and diverged in the drying zone and rollers 24, 25. Each strand 28 is then fed to an array 30 of alignment tubes or guide eyes 31 and take up reels 32 which are contact driven by a plurality of shafts 33 powered from a motor 34 and drive belt 35. The alignment tubes oscillate in the direction shown by the arrows by conventional means (not shown); as illustrated in FIGS. 7 (*a–c*) the alignment tubes are of a conventional structure. The use of contact drives enables a uniform drive tension to be maintained on each reel and virtually eliminates catenary effects. Each take up reel is mounted slightly forwardly on a stationary shaft 32*a*, in a slot 32*b* and off-center of the drive shaft so that if a strand breaks during the wind up operation, its reel 32 will roll forwardly and out of alignment with the remainder of the reels. Retaining bars 36 are provided to constrain further movement of a reel. A misaligned reel can be easily noticed and serviced immediately. If the tension on a specific strand becomes too great, its reel will stall until the tension equalizes. The use of oscillating alignment tubes enables a uniform laydown of the strands on their respective reels.

When the wind-up operation has been completed, the loaded reels may be wound up into a standard textile package for commercial use. Alternatively, the reel wind-up operation may be bypassed and the strands 28 may be fed directly to a graphite weaving step.

Typical weave patterns include: 4 and 8 harness twills, 8 harness satin, unidirectional, etc. Use of the strands produced by the process of this invention permits the graphite fabric to have controlled and/or uniform properties regardless of weave structure.

FIGS. 2–5 are SEM micrographs at various magnifications showing an example of a graphitized fabric woven from aligned 3 mil diameter strands using the process and apparatus of FIG. 1. It will be apparent that a uniform weave is produced with very few stray ends. Also, no apparent degradation in physical properties occurred, the original high modulus of elasticity (about $75\times10^6$ psi) of the fibers in the tape being retained.

EXAMPLE

A tape of graphitized fiber sold by the Celanese Corporation, Advanced Engineering Composites, under the registered trademark of "Celion GY-70" was converted to strands using the apparatus and process of FIG. 1. The fiber employed a polyacrylonitrile precursor which has been graphitized at a temperature above 3,000° C. and which was surface treated to improve adhesion to organic polymers. The GY-70 had the following properties: Tensile Strength* $270\times10^3$ psi; Tensile Modulus*: $75\times10^6$ psi; Ultimate Elongation* 0.38%; Density: 0.071 lb./ft$^2$. and, Electrical Resistivity: 3,900 ohms-mil-ft.

*Single filaments were tested at a gauge length of 1 inch.

Filament and tape characteristics were as follows: Diameter: $0.33\times10^{-3}$ inches; Shape: Bilobal; Twist: 0.5 turns/in.; Tape Width: 2.75 inches; Cross section area of fiber in tape: 0.01 in.$^2$; Weave: a light carbonized filling yarn (2 picks/inch) is present to help maintain GY-70 yarn collimation. The filling yarns are discontinuous and do not provide transverse integrity to the tape.

Following separation and reel wind-up, according to the invention, the above properties showed no change whatsoever. The single end strands produced by the process and apparatus of this invention are sold by the Celanese Corporation, Advanced Engineering Composites under the registered trade name of "Celion GY-70SE".

I claim:

1. A process for aligning graphite strands from a tape of graphitized fibers which comprises the steps of:

i. initially separating individual graphite strands from the tape;

ii. diverging the strands while separating the strands from the graphitized tape under tension;

iii. feeding each strand through a separate alignment tube; and, iv. winding up a plurality of strands, each strand being on a separate aligned reel, a plurality of aligned reels having at least one drive rod therefor, each reel being maintained forwardly in off-centered contact with the drive rod due to strand tension, whereby release of strand tension causes the reel to move out of alignment.

2. The process of claim 1 in which the strands are sized.

3. The process of claim 1 comprising at least one contact drive rod for the reels, each reel being maintained in alignment under tension of the strand forwardly of the drive rod, whereby release of strand tension causes the reel to move out of alignment, and an increase of tension is compensated by reel stalling until tension becomes equalized.

4. An apparatus for aligning graphite strands from a tape of graphitized fibers comprising:

i. means to initially separate individual strands from the tape;

ii. means to tension the separated strands;

iii. means to diverge and align the strands; and, iv. means to wind-up the strands on reels under uniform tension by direct contact drive, the reels being aligned and having at least one drive rod therefor, each reel being maintained forwardly in off-centered contact with its drive rod due to strand tension, whereby release of strand tension causes the reel to move out of alignment.

5. The apparatus of claim 4 in which the tape is unwound under tension.

6. The apparatus of claim 4 comprising a plurality of alignment tubes, each tube adapted to align a single strand.

7. The apparatus of claim 4 comprising a plurality of reels, each reel adapted to wind up a single strand.

8. The apparatus of claim 4 comprising sizing means for the strands.

9. The apparatus of claim 4 comprising at least one contact drive rod for the reels, each reel being maintained in alignment under tension of the strand forwardly of the drive rod, whereby release of strand tension causes the reel to move out of alignment, and an increase of tension is compensated by reel stalling until tension becomes equalized.

10. The apparatus of claim 4 in which the graphite strands are in the form of a strip supported on the tape.

* * * * *